United States Patent [19]

Huffman, Jr.

[11] 4,154,272

[45] May 15, 1979

[54] LAMINATED BOARD PRESS

[76] Inventor: Coy L. Huffman, Jr., 107 Brookside Way, Greenville, S.C. 29601

[21] Appl. No.: 757,377

[22] Filed: Jan. 6, 1977

[51] Int. Cl.[2] ..... B27D 3/02

[52] U.S. Cl. ..... 144/281 R; 91/530; 92/37; 100/195; 100/199; 156/288; 156/563; 254/93 HP; 425/338; 425/389

[58] Field of Search ..... 425/338, 389, 390; 254/93 HP; 156/288, 563; 100/195, 199; 144/281 R, 281 C, 281 D, 283; 91/414; 92/37

[56] References Cited

U.S. PATENT DOCUMENTS

| | | | |
|---|---|---|---|
| 2,338,329 | 1/1944 | Hermanns | 425/338 |
| 2,913,027 | 11/1959 | Thurnher | 144/281 D |
| 3,159,694 | 12/1964 | Wiles et al. | 425/338 X |
| 3,237,246 | 3/1966 | Carlsson | 425/338 |
| 3,331,411 | 7/1967 | Cecchi | 144/281 R |
| 3,730,366 | 5/1973 | Berends | 254/93 HP |
| 3,850,559 | 11/1974 | Mintz et al. | 425/389 X |

FOREIGN PATENT DOCUMENTS

| | | | |
|---|---|---|---|
| 1182795 | 12/1964 | Fed. Rep. of Germany | 100/199 |

*Primary Examiner*—Donald R. Schran
*Assistant Examiner*—W. D. Bray
*Attorney, Agent, or Firm*—Bailey, Dority & Flint

[57] ABSTRACT

A device for separating the platens of a press so that wooden blanks in an unpressed form can be readily loaded therebetween. The device includes outwardly extending arms carried on the corners of each of the platens. Pneumatically operated bellows are provided between cooperating pairs of outwardly extending arms which are carried on diagonally opposite corners of each of the platens for separating the platens when pressurized. Alternate pairs of platens have pairs of bellows interposed between the outwardly extending arms carried on different diagonals. A switch is carried below the press for disengaging the pneumatic system when the press is being closed.

1 Claim, 4 Drawing Figures

LAMINATED BOARD PRESS

BACKGROUND OF THE INVENTION

The present invention relates to a press and, more particularly, to a press for pressing blanks of laminated sheets which are subsequently cut into shapes for making picker sticks for use on looms.

Heretofore, presses have been utilized for pressing substantially square shaped wooden blanks consisting of a plurality of sheets of wood with glue interposed therebetween. These blanks are compressed into a densified square blank which is subsequently sawed into picker sticks. These blanks are often warped making them very difficult to be inserted into slots provided between platens of the press. Heretofore, in order to insert the wooden blanks into the openings provided between the platens of the press, an operator normally inserted a corner thereof into the opening. He then used a board to drive the blanks into the opening. As a result, normally two operators were required to load the press and it consumed from fifteen to thirty minutes loading time.

Furthermore, the wooden blanks were often warped to such an extent that they could not be placed into the openings. These presses heretofore utilized had abutments provided therein which, when the press was opened, limited the openings between the particular platens to approximately 2 inches.

SUMMARY OF THE INVENTION

The present invention pertains to an apparatus for selectively separating the platens of the press for aiding in loading wooden blanks between adjacent platens. The press has a plurality of platens stacked one above the other with openings provided therebetween into which the wooden blanks that are to be compressed are inserted. An hydraulically operated cylinder is used for moving a base member relative to the top member for closing the press. Outwardly extending projections are carried on each of the platens. Fluid operated bellows are interposed between these outwardly extending projections of adjacent platens. Valve means are utilized for selectively supplying pressurized fluid to the fluid operated bellows for separating adjacent platens so that the wooden blanks can be inserted therebetween. Cooperating pairs of outwardly extending arms are carried on opposite corners of each of the platens. The bellows are interposed between these outwardly extending arms of adjacent platens. The pressurized air is selectively supplied to a pair of bellows carried adjacent diagonally opposite corners of the platens for separating the adjacent platens. Alternate pairs of bellows are carried on the other diagonally opposite corners.

Acordingly, it is an important object of the present invention to provide a mechanism for selectively opening the platens of a press so that wooden blanks can be inserted therebetween.

Another important object of the present invention is to provide an apparatus that is relatively simple to operate that enables a single operator to selectively open platens of a press so that wooden blanks can be inserted therebetween.

These and other objects and advantages of the invention will become apparent upon reference to the following specification, attendant claims and drawings.

DESCRIPTION OF THE PREFERRED EMBODIMENT

Figure 1:
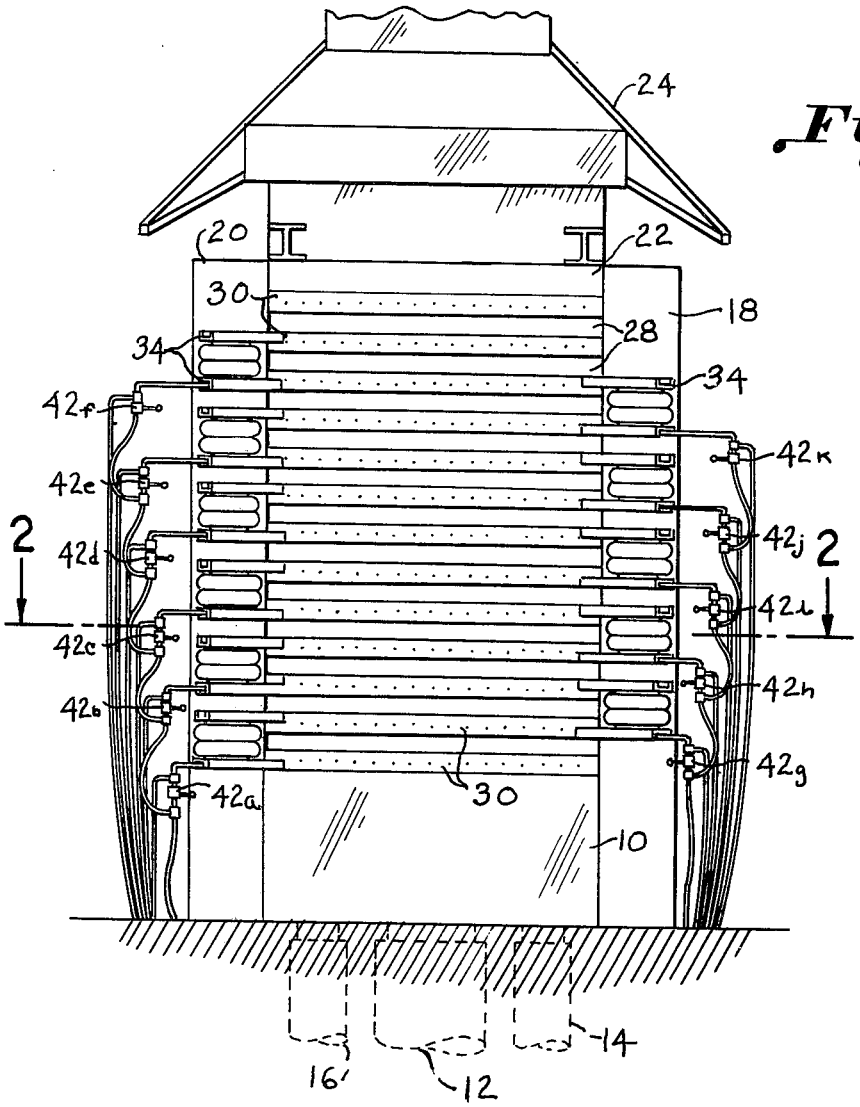
FIG. 1 is an elevational view illustrating a press equipped with apparatus for separating the platens thereof constructed in accordance with the present invention.
Figure 2:
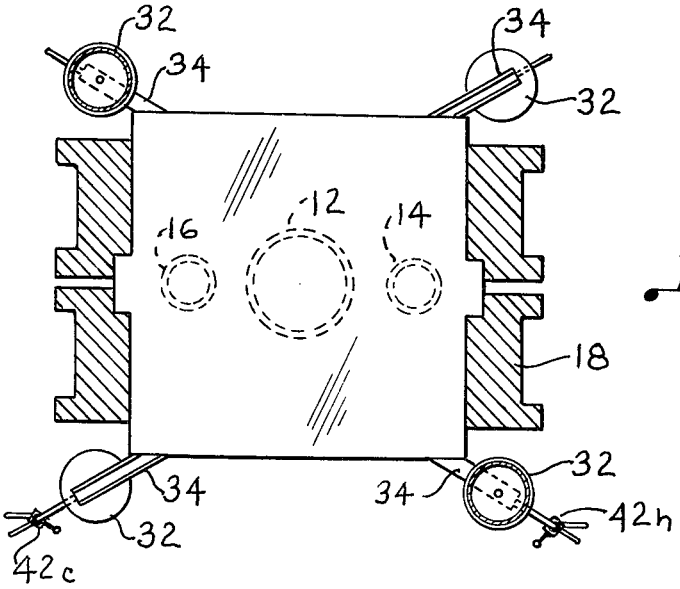
FIG. 2 is a sectional view taken along line 2—2 of FIG. 1.

Referring in more detail to FIG. 1 of the drawing, there is illustrated a press having a movable base member 10 which is raised and lowered by three hydraulically operated cylinders 12, 14 and 16 interposed therebelow. The press includes side walls 18 and 20 which are joined by a fixed top 22. Positioned on top of the fixed top 22 is a hood 24. The platens are equipped with hoses (not shown) so that steam and cool water can be inserted therein for heating and cooling the platens to desired temperatures during the pressing and cooling cycles of operation of the press.

Figure 3:
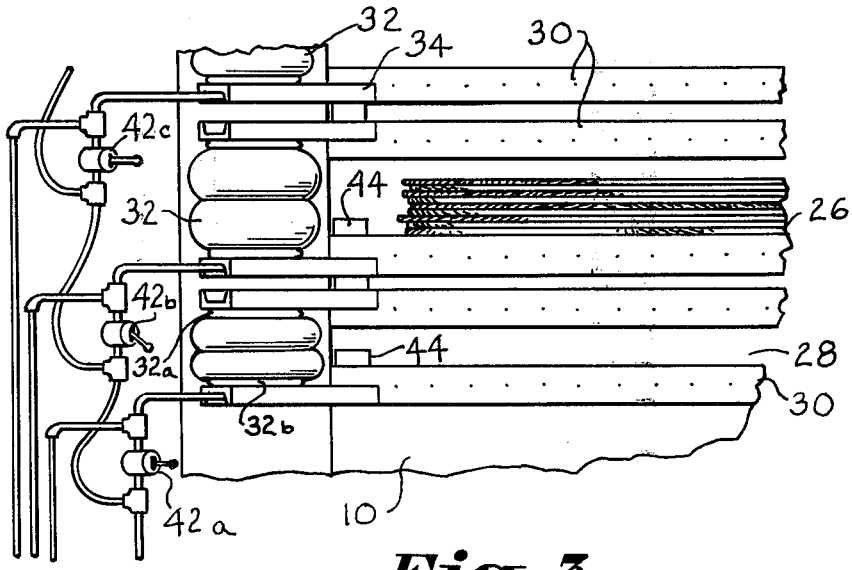
FIG. 3 is an enlarged elevational view illustrating a portion of the press with one of the bellows pressurized for separating a pair of adjacent platens.

Wooden blanks 26, such as illustrated in FIG. 3, are inserted into the slot 28 provided between the adjacent platens 30. As illustrated in FIG. 1 of the drawing, there are thirteen platens. All of the platens, except for the top platen 30, are movable and as the press is closed, the openings between the platens are reduced. In one particular press, the stroke of the base member 10 is 14 inches. Since there are twelve openings provided in the press, the height of each opening is reduced to slightly more than 1 inch. Normally, when the press opens, there is approximately a 2 inch opening provided between each of the platens.

As previously mentioned, this is often not sufficient space to insert a pallet 26 therebetween. In order to selectively separate the platens 30 when the press is opened, pneumatically operated bellows 32 are utilized. The bellows 32 are interposed between outwardly extending arms 34 carried on each corner of each platen. A pair of bellows 32 which are interposed between the outwardly extending arms carried on diagonally opposite corners of the platens 30 are used for separating the respective pairs of platens 30. Alternate pairs of platens are carried on different diagonals. Thus, the lowermost pair of bellows (only one of the pair being illustrated in FIG. 1 since the other bellow is carried on the diagonally opposite corner) is used for separating the bottom and next to the bottom platen. Assuming that these platens are consecutively numbered from the bottom of the press, they would be used for separating platens 1 and 2. The second pair of bellows which are carried on the opposite diagonal corners is used for separating the platens 2 and 3.

FIG. 3 illustrates the bellows 32 carried in the center of the drawing being pressurized to separate the third from the bottom platen from the fourth from the bottom platen so that the wooden blank 26 can be inserted therebetween.

Figure 4:
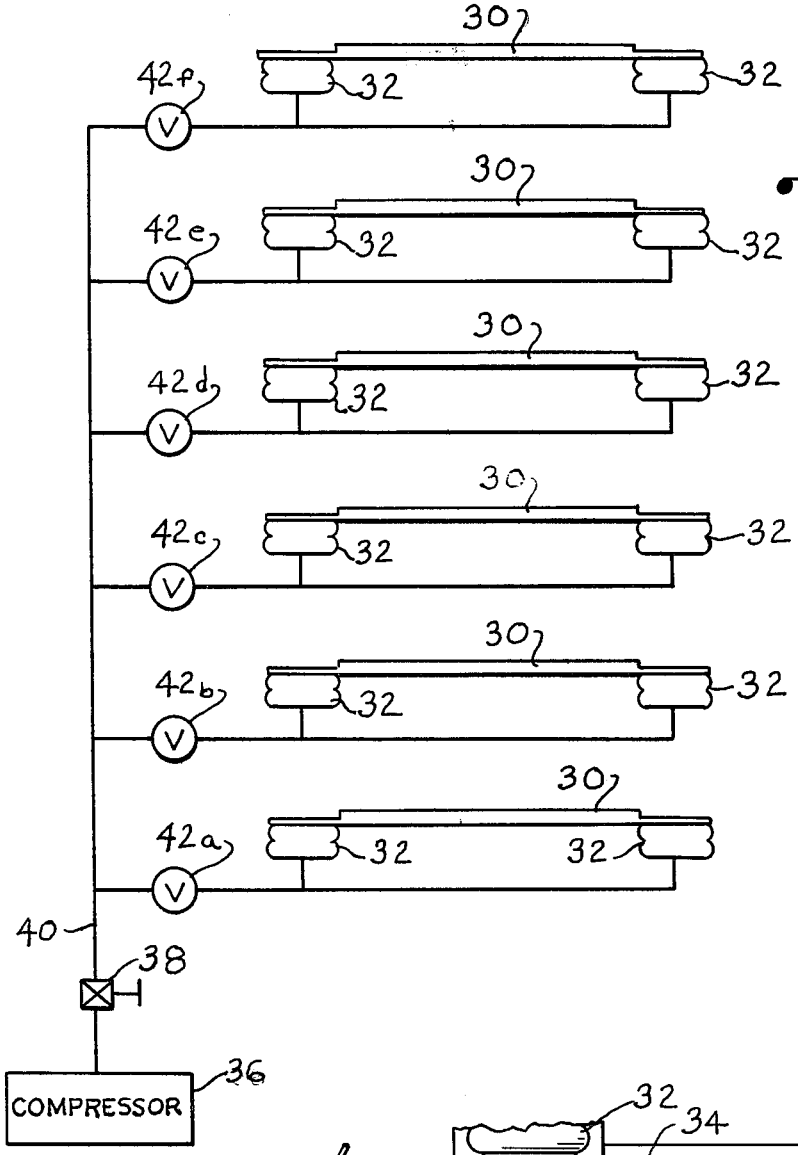
FIG. 4 is a schematic diagram illustrating the flow diagram for the pressurized fluid used for pressurizing the bellows of apparatus forming a part of the invention.

Referring in more detail to FIG. 4 of the drawings, there is illustrated a flow diagram for the bellows 32. The system includes a compressor 36 which supplies pressurized air through a main valve 38 through lines 40 to individually operated valves 42*a* through 42*f* as illustrated in FIG. 4. It is to be understood, of course, there is an individually operated valve for each pair of bellows and only one-half of the pairs of bellows is illustrated in FIG. 4. The other set of bellows are operated by the manually operated valves 42*g* through 42*k*. The main vlave 38 is carried underneath the base member 10 so that when the base member is lowered for opening the press, it pushes down on the plunger connected to the valve 38 for allowing pressurized air to flow from the compressor to the valves associated with the individual bellows.

As illustrated in FIG. 3, stops 44 are provided in the gap between the platens so that when the press is closed, the wooden blank is compressed down to a thickness equal to the thickness of the metal stop 44.

When the press is closed by the hydraulic cylinder raising the base member 10 upwardly, it is necessary for bellows 32 to be compressed sufficiently so as to allow the platens 30 to be compressed against the stops 44. When the press is again opened, the bellows 32 normally remain in their compressed state until they are selectively pressurized for loading the blanks 26 into the slots between the platens 30. As illustrated in FIG. 3 of the drawing, there is a metal disc 32*a* and 32*b* on the top and bottom of each of the bellows for engaging the outwardly extending arms 34. When the press is closed, these metal discs 32*a* and 32*b* are substantially flush against each other with merely the surface of the bellows interposed therebetween.

One advantage in utilizing the bellows 32 is that they permit the platens to be closed sufficiently in order to compress the blank 26 to approximately $\frac{7}{8}$ inch. When they are pressurized, they can open the platens wherein there is a space of approximately 4 to 6 inches therebetween.

While a preferred embodiment of the invention has been described using specific terms, such description is for illustrative purposes only, and it is to be understood that changes and variations may be made without departing from the spirit or scope of the following claims.

What is claimed is:

1. An apparatus for selectively separating the platens of a press for aiding in loading wooden blanks between adjacent platens, said press having a plurality of platens stacked one above the other with openings provided therebetween into which said wooden blanks which are to be compressed are inserted, and a hydraulic cylinder for moving a base member relative to a top member for opening and closing said press, said apparatus comprising:

(a) a pressurized source of fluid;

(b) cooperating pairs of outwardly extending arms carried on diagonally opposite corners of each of said platens;

(c) a plurality of pairs of fluid operated bellows, one of each pair of bellows being interposed between respective outwardly extending arms carried by adjacent platens and the other bellows of each pair of bellows being interposed between outwardly extending arms carried on diagonally opposite corners of the same platens;

(d) fluid lines extending from said source of pressurized fluid and respective pairs of bellows;

(e) a plurality of mechanically activated valves vertically spaced adjacent said press, each of said valves being connected in one of said fluid lines between said pressurized source of fluid and a pair of said bellows for selectively supplying fluid to that particular pair of bellows for opening platens carried on opposite sides thereof;

(f) a main valve carried below said base member of said press, (g) said main valve being connected between said source of pressurized fluid and said fluid lines for being opened by said base member when said base member is lowered so as to activate the valves associated with said pairs of bellows only when said press is opened.

* * * * *